United States Patent [19]

Layne

[11] 4,429,548

[45] Feb. 7, 1984

[54] COVER FOR REFRIGERATED DISPLAY CASES

[76] Inventor: Richard C. Layne, 1312 King Ave., Apt. 4, Columbus, Ohio 43212

[21] Appl. No.: 328,415

[22] Filed: Dec. 7, 1981

[51] Int. Cl.[3] ..... A47F 3/04

[52] U.S. Cl. ..... 62/255; 62/256; 62/265; 312/116

[58] Field of Search ..... 62/255, 256, 265; 312/116; 160/99, 184

[56] References Cited

U.S. PATENT DOCUMENTS

| | | | |
|---|---|---|---|
| 2,041,258 | 5/1936 | Mitchell | 62/265 X |
| 3,241,899 | 3/1966 | Donker | 62/255 X |
| 3,542,445 | 11/1970 | Donker | 312/116 |
| 4,186,790 | 2/1980 | Schenker et al. | 312/116 X |
| 4,288,992 | 9/1981 | Eliason | 62/256 |
| 4,296,792 | 10/1981 | Gidge et al. | 312/116 X |

*Primary Examiner*—Lloyd L. King
*Attorney, Agent, or Firm*—Frank H. Foster

[57] ABSTRACT

A cover for refrigerated display cases formed from a plurality of flexible, transparent, PVC strips attached together in side by side relation to form panels which extend across the display case access opening to provide a barrier which substantially reduces the heat transfer between the store environment and the display case contents.

6 Claims, 11 Drawing Figures

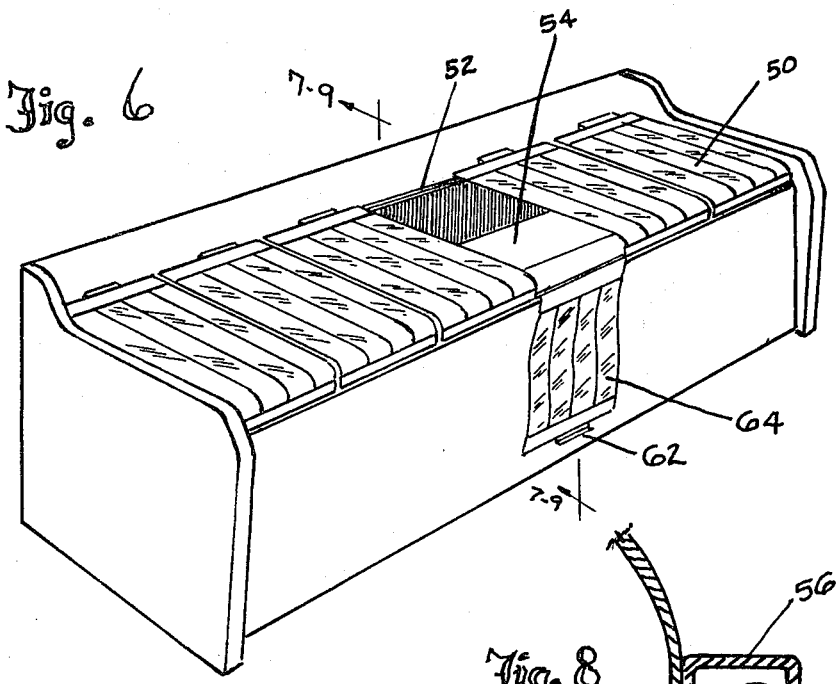
Fig. 6
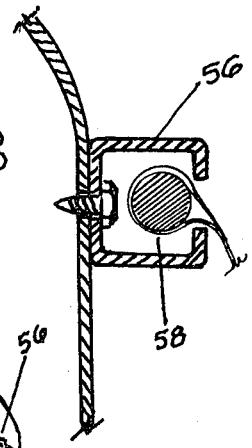
Fig. 8
Fig. 7
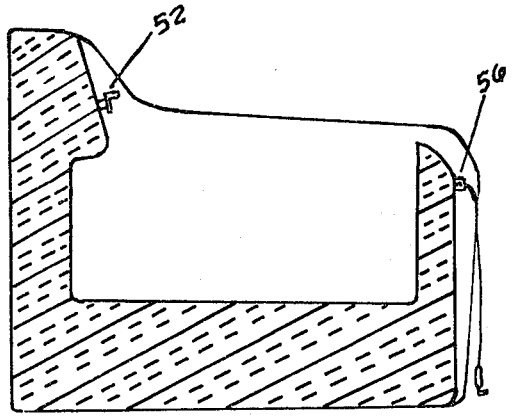
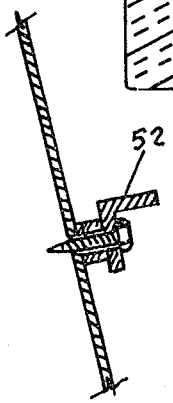
Fig. 9

COVER FOR REFRIGERATED DISPLAY CASES

TECHNICAL FIELD

This invention relates to covers for providing a barrier over the access opening of refrigerated display cases and more particularly relates to a cover which forms an easily deformable barrier which permits viewing of and easy access by the customer to the produces displayed while providing greatly improved separation between the environment in the display cases and the ambient environment of the store.

BACKGROUND ART

Refrigerated display cases have long been used by merchants, such as in grocery stores, for refrigerating or freezing the food products in order to safely preserve them against deterioration while at the same time displaying them in an available and visible manner which is attractive to customers. A problem arises, however, because people prefer considerably different environmental temperatures than are appropriate for food preservation and yet, self serve stores prefer display cases which are open to provide easy access to products in order to encourage their purchase. The resulting problem is that air may freely circulate between the store environment and the interior of the display cases.

This free communication has two undesirable effects. It cools the store environment and warms the interior of the display cases. The cooler store is less comfortable for customers and therefore more energy must be used to heat the store. The warmer display case reduces shelf life of the food products. The free communication also facilitates the formation of frost and ice in the display cases. All this requires more energy.

Designers of display cases have sought to reduce these problems by providing for the circulation of cool air along a path within the display case and by making the access opening of freezer cases at their top to take advantage of the heavier weight of cold air. However, with the recent sharp rise in energy costs, the undesirable heat transfer from store environment into refrigerated display cases has been a matter of increased concern for store proprietors.

One attempt to solve this problem is the provision of overnight covers over the display cases. Although these are quite helpful and effective during the night hours, they must be removed during store operating hours so that customers can view and have access to the products. Thus, during the important operating hours when store temperatures are of greater concern, the overnight covers are not used so the same old problems exist.

Another approach has been the provision of sliding or hinged solid doors. Although such doors provide an effective barrier between the store environment and the interior of the display cases, they also require more customer effort to gain access to the displayed products. Thus, they are not only a barrier to air circulation, but are also a barrier to customer access to food products and therefore a deterrent to sales. Additionally, such rigid covers require significant maintenance and often are provided with heating elements on the interior surface which are made necessary in order to remove moisture condensation on the barrier in order to maintain a clear, transparent barrier which does not reduce the visibility of the products. Additionally, such solid barriers are considerably more expensive than embodiments of the present invention and are considerably more difficult to retrofit to existing display cases.

It is therefore an object of the present invention to provide an improved refrigerated display case cover which is inexpensive, provides an effective barrier to air circulation between the store environment and the interior of the display case and yet maintains maximum product visibility and customer access to the products.

A further object of the present invention is to provide a barrier which permits the refrigerated display case to be maintained at a colder and more constant, uniform temperature while permitting the store to be maintained at a warmer more comfortable temperature and at the same time to provide an energy cost savings.

It is a further object of the invention to provide a barrier which substantially reduces the heat transfer from the store environment into the display case so that food may be kept fresher and will have a longer shelf life.

Yet another object of the invention is to provide a barrier which does not sufficiently attract moisture condensation and which reduces the frost and ice buildup within the display case therefore requiring fewer defrost cycles and less labor because it needs to be cleaned less often.

Yet another object of the present invention is to provide a display case cover with the above advantages but which can also be conveniently removed from the display case access opening to provide easy access for restocking and cleaning of the display cases.

Yet another object of the present invention is to provide a display case cover which is easily attached to existing cases.

BRIEF DISCLOSURE OF THE INVENTION

The cover for a refrigerated display case and embodying the present invention comprises a plurality of flexible, transparent strips mounted to the display case and extending across the access opening of the display case.

Preferably, the strips are attached together in groups to form panels. One end of each panel is connected to an arm which may be removable from the display case, such as a chest type display case, or which is hinged to the upper edge of an upright type display case. Removal or pivoting of the arm provides a large opening suitable for stocking and cleaning.

Customers can conveniently reach between the transparent strips to grasp a product with essentially the same unimpeded physical movements as when there is no cover.

BRIEF DESCRIPTION OF THE DRAWINGS

FIG. 6 is a view in perspective of a chest type display case having covers embodying the present invention.

FIG. 7 is a view in vertical section taken substantially along the lines 7—7 of FIG. 6 illustrating the cover embodiment of the invention illustrated in FIG. 6.

FIG. 8 is a detailed view in vertical section of a segment of the embodiment of FIG. 8 illustrating the attachment of a panel of flexible strips to the front edge of the display case of FIG. 6.

FIG. 9 is a view in vertical section of a segment of the embodiment of the invention illustrated in FIG. 6 illustrating the attachment of the rear arm of a panel of transparent strips to the rear edge of the access opening of the chest freezer illustrated in FIG. 6.

Figure 1:
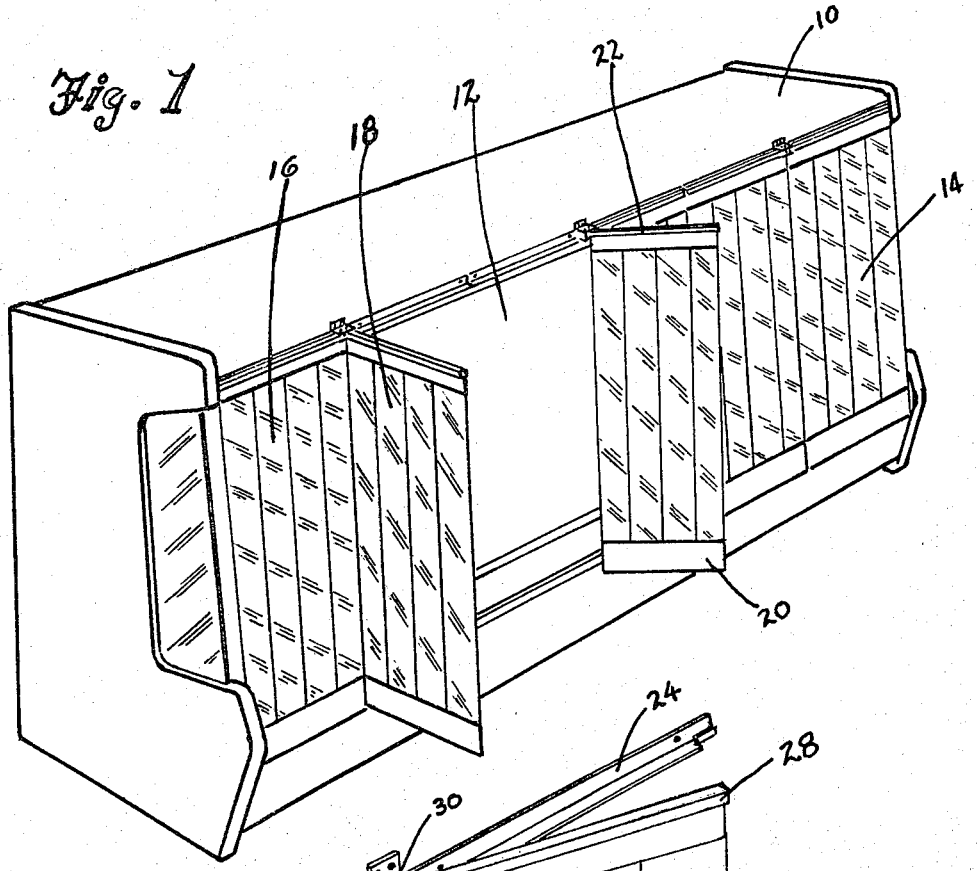
FIG. 1 is a view in perspective of an upright display case having covers embodying the present invention mounted thereto.

In describing the preferred embodiment of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DESCRIPTION OF THE BEST MODE FOR CARRYING OUT THE INVENTION

FIG. 1 illustrates an upright display case 10 such as conventionally used for the refrigerated display of dairy products. Its access opening 12 is covered by a plurality of flexible, transparent strips, such as transparent vinyl strips 14, which are mounted to the display case in substantially side by side relationship extending across the access opening 12.

The strips are attached together in groups to form panels, such as panels 16 and 18. The display case of FIG. 1 is provided with 6 such panels. Each of the panels is movably mounted at one end of the strips at the relatively higher edge of the opening so that they may be moved away from the access opening 12 of the display case 10 to facilitate stocking or cleaning of the display case 10. A fabric border 20 is sewn to the bottom of each panel and preferably contains distributed weight members to increase the gravitational forces exerted on the panels to keep them taut and thereby maintain the panels and their transparent strips in alignment whenever a customer is not reaching into the display case.

Figure 2:
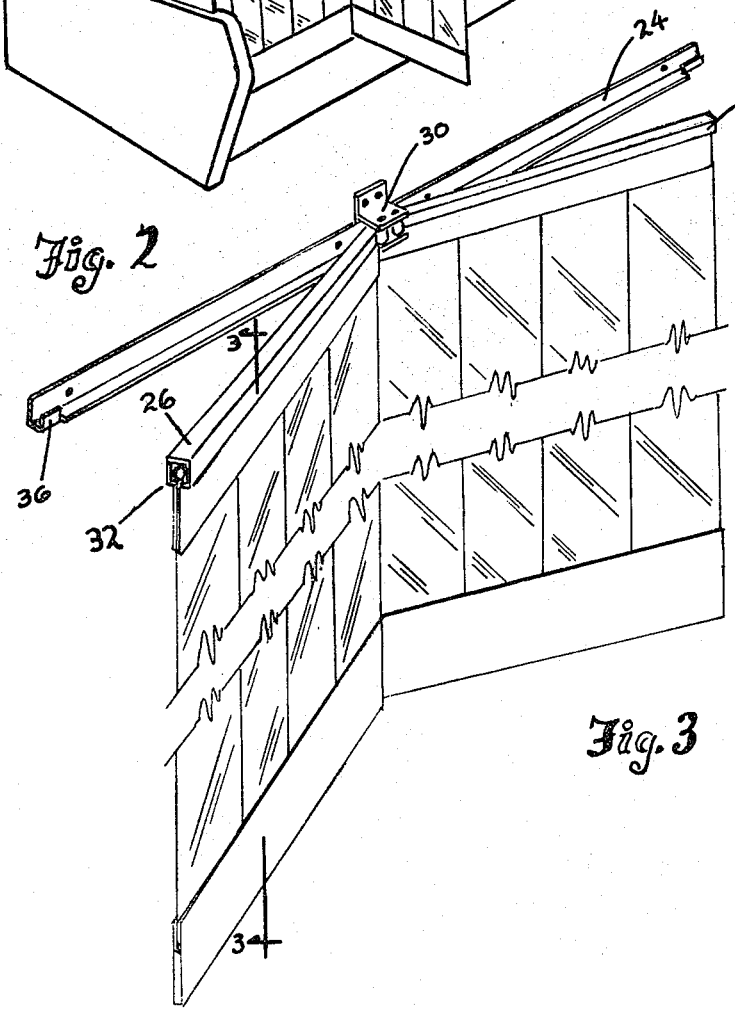
FIG. 2 is a view in perspective illustrating a detail of the hinged arms of the cover illustrated in FIG. 1.

Preferably, the upper end of each panel of strips is mounted to an arm, such as arm 22, which is hingedly mounted to the relatively higher edge of the access opening 12. FIG. 2 illustrates the support arms in more detail. As illustrated in FIG. 2, a mounting strip 24 is fastened to the upper edge of the access opening 12 of the display case. Support arms 26 and 28 are pivotally mounted to the support strip by means of a double hinge 30 so that each may swing forwardly and preferably around the front of its associated panel to provide completely open access to a portion of the display case without impeding traffic past the front of the display case. As is revealed in FIG. 2 and in more detail in FIG. 3, each of the support arms comprises a channel member with an open end 32. Preferably the channel opens downwardly. The upper edge of each panel is provided with an elongated bead portion 34 so that the bead 34 may be slid into the channel longitudinally with the panel extending downwardly through the opening of the channel and retained in the support arm by the bead 34. This means of attachment permits the panels to be easily and quickly removed for cleaning or replacement and then quickly and easily replaced.

Although the support arms could all extend in the same direction from their hinge, preferably they extend in alternately opposite directions so opposed pairs of panels may be swung open to provide an unobstructed access to the case equal to twice the width of each panel.

Spaced along the support strip 24 and positioned near the outward end of each support arm are upstanding tangs, such as tang 36 to provide releasable latches for the support arms. The tangs retain the arms in position along the support strip. The support arms 28 are swung outwardly by first lifting them upwardly to lift the open slot of the channel away from and free of the tang and then pivoting the arm outwardly. This procedure is reversed for releasably latching the arms to the support strip by means of the tangs.

Figure 3:
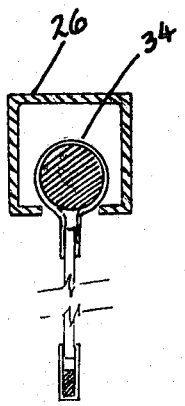
FIG. 3 is a view in vertical section of a segment of the embodiment illustrated in FIG. 2 illustrating the retention of the transparent strips in the pivotal arms.
Figure 4:
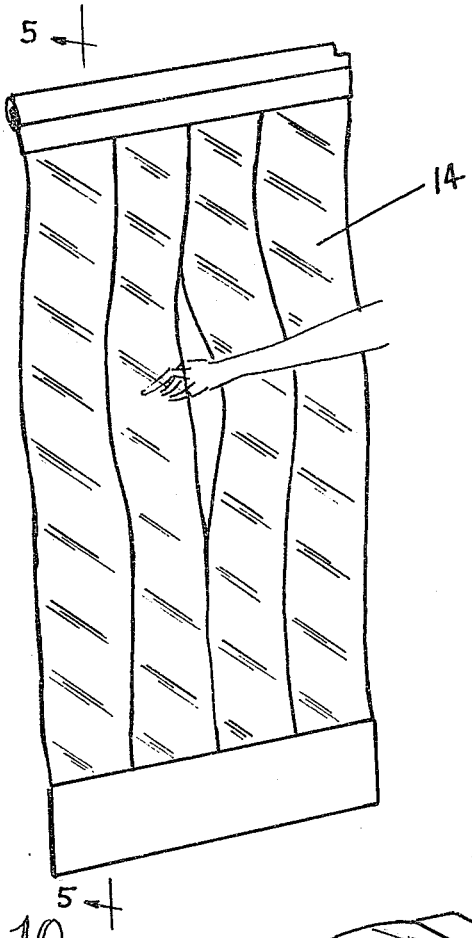
FIG. 4 is a view in perspective illustrating the customer reaching into a display case to retrieve a desired product.
Figure 5:
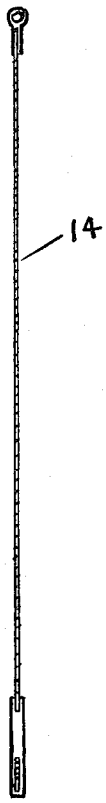
FIG. 5 is a view in vertical section of the cover illustrated in FIG. 4 and taken substantially along the lines 5—5 of FIG. 4.
Figure 10:
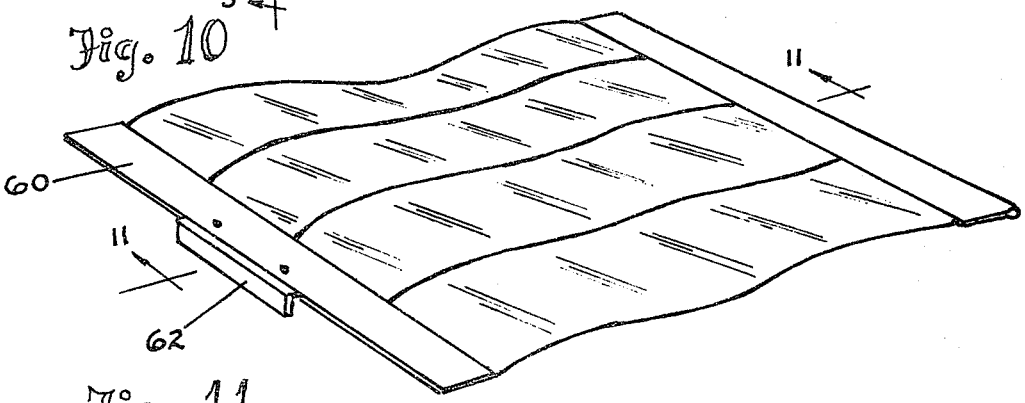
FIG. 10 is a view in perspective of a panel of transparent strips of the embodiment of FIG. 6.
Figure 11:
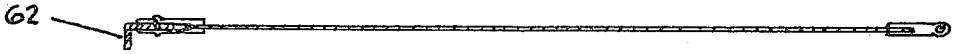
FIG. 11 is a view in vertical section taken substantially along the line 11—11 of FIG. 10 of the transparent strip illustrated in FIG. 10.

FIGS. 6 and 7 illustrate a refrigerated display case such as commonly used for storing frozen foods. It too is provided with a plurality of flexible, transparent strips 50 which extend from the relatively higher rearward edge 52 of its access opening 54 forwardly over the front edge of the access opening into a channel member 56 illustrated in more detail in FIG. 8. The strips 50 are attached together in groups to form panels and in the mamnner of the bead 34 of FIG. 3 are formed along their forward edge of each panel with a bead portion 58. The bead 58 slides into the channel 56. The rearward edge of each panel is attached to a relatively rigid arm 60 illustrated in the detailed view of FIG. 10 of an entire panel. The arm 60 is releasably attached to the upper rearward edge 52 of the access opening 54. This releasable attachment may, in the preferred embodiment, be accomplished simply by formation of a downwardly extending tang 62 formed on the arm 60 which extends into a slot formed to receive the tang 62.

This means of attachment permits each panel to conveniently be released from its rearward attachment and pulled forward and downwardly so that it will be suspended along the front of the chest freezer as illustrated with panel 64 in FIG. 6. In this manner the access opening is completely open and unobstructed for purposes of cleaning and restocking.

It is preferred that panels for upright display cases be made 24 inches wide in modules of two oppositely swinging arms because such modules provide integral multiples of the length of most display cases. This also permits an opening for stocking for 48 inches.

Various alternative structures are possible without departing from the spirit of the present invention. For example, it is desirable for some display cases, such as those which display large packages such as 12 packs of beer, to have the strips spaced apart on the order of 2 inches. This facilitates the withdrawal of items from the display case by the customer.

As yet another alternative, the flexible strips of each panel can be formed from one large sheet of flexible, transparent material by cutting slits in the large panel through the intermediate portion but not extending to the top and bottom edges of the sheet. In this manner a unitary panel formed of multiple strips would be formed which is attached together at its top and bottom.

The cover of the present invention operates to very substantially reduce heat transfer between the ambient room and the refrigerated display case by providing a barrier which maintains a laminar flow of recirculating air within the display case. Thus, the turbulent mixing of display case air with ambient air is prevented. The barrier provides more than just an insulative barrier. Consequently, even if the strips are spaced as described above, the effectiveness of a cover embodying the present invention is reduced only a little because the strips still serve to maintain that laminar flow.

The principal advantage of the present invention to the customer is that the customer shops and retrieves desired articles in the same manner as is done without the covers of the present invention. Thus, a shopper wheels her cart along the display case and visually observes the products which are available. Upon observing a desired product the shopper merely reaches nearly directly toward the product, with a minimum of deviation from a direct path to the product in order to insert her hand between the strips directly in front of her. The strips may be parted either by inserting the hand between the strips or by grasping the strips with one hand and then inserting the other hand through the strips to retrieve the product. The product is retrieved by merely withdrawing it directly toward the shopper and placing it in the basket in the same manner as done without covers embodying the present invention.

The shopper is not confronted with flexible covers to roll back or rigid doors to swing around in order to retrieve an object. After an item is retrieved the shopper does not have to close a door or return a cover to its protective position. The flexible panels automatically return to their protective positions and therefore the effectiveness of the invention is not dependent upon the actions of the shoppers.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

I claim:

1. An improved refrigerated, upright type display case cover for providing an easily deformable barrier over the display case access opening, said cover being of the type having a plurality of flexible, transparent strips mounted to said display case in substantially side by side relationship and extending across said access opening, wherein the improvement comprises: said strips attached together in groups to form panels which are movably mounted at one end along a relatively higher edge of said opening, extend parallel to each other across a relatively lower edge and are held across said opening by gravitational force and wherein the relatively higher end of each panel of strips are mounted to an arm which is hingedly mounted to said relatively higher edge.

2. A cover apparatus in accordance with claim 1 wherein each of said arms comprises a channel member having an open ended channel along its length and the relatively higher edge of each group of strips is provided with an elongated bead portion for removably sliding into said channel.

3. A cover apparatus in accordance with claim 2 wherein the strips of each panel are connected together at their opposite ends and to weight members along the relatively lower edge of each panel.

4. A cover apparatus in accordance with claim 1 wherein said arms are hingedly mounted to extend from their hinged connections in alternately opposite directions.

5. A cover apparatus in accordance with claim 1 wherein the arms are releasably latched to the relatively higher edge of said case to releasably hold them against said relatively higher edge.

6. An improved refrigerated chest type display case cover for providing an easily deformable barrier over the display case access opening, said cover being of the type having a plurality of flexible, transparent strips mounted to said display case in substantially side by side relationship and extending across said access opening, wherein the improvement comprises: said strips attached together in groups to form panels which are movably mounted at one end along a relatively higher edge of said opening, extend parallel to each other across a relatively lower edge and are held across said opening by gravitational force and wherein the relatively higher end of each panel of strips are mounted to an arm which is releasably attached to said relatively higher edge to permit each panel to be folded forwardly and out of the way of said opening.

* * * * *